US006411889B1

(12) United States Patent
Mizunuma et al.

(10) Patent No.: US 6,411,889 B1
(45) Date of Patent: Jun. 25, 2002

(54) INTEGRATED TRAFFIC MONITORING ASSISTANCE, AND COMMUNICATIONS SYSTEM

(75) Inventors: Ichiro Mizunuma, Brighton; Ichiro Masaki, Boxborough, both of MA (US)

(73) Assignees: Mitsubishi Denki Kabushiki Kaisha, Tokyo (JP); Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 09/657,522

(22) Filed: Sep. 8, 2000

(51) Int. Cl.[7] ..... G08G 1/01
(52) U.S. Cl. ..... 701/117; 701/207; 340/928
(58) Field of Search ..... 701/117, 207; 340/928, 933; 705/13

(56) References Cited

U.S. PATENT DOCUMENTS 4,006,315 A * 2/1977 Halstead ..... 179/82
5,602,375 A * 2/1997 Sunahara et al. ..... 235/384
5,717,390 A * 2/1998 Hasselbring ..... 340/933
5,850,191 A * 12/1998 Yagi et al. ..... 340/928
5,872,525 A * 2/1999 Fukasawa et al. ..... 340/928
5,963,149 A * 10/1999 Nagura et al. ..... 340/933
6,064,320 A * 5/2000 D'Hont ..... 340/933
6,166,659 A * 12/2000 Kusano ..... 340/928
6,219,613 B1 * 4/2001 Terrier et al. ..... 701/207
6,269,302 B1 * 7/2001 Yoshida ..... 701/207

* cited by examiner

*Primary Examiner*—Tan Nguyen
(74) *Attorney, Agent, or Firm*—Leydig, Voit & Mayer, Ltd.

(57) ABSTRACT

A traffic monitoring, driver assistance, and communications system includes lane terminals arranged along a direction of travel of a highway, each lane terminal including a sensor for detecting passage of a vehicle, a communication antenna, a terminal transceiver for communicating with a passing vehicle through the communication antenna, and a network backbone linking the lane terminals to a data processor for compiling information on passing vehicles sensed. The system permits complex toll assessment on toll roads. By using a larger number of short range antennas, cellular communication is possible with a very large number of moving vehicles without increasing bandwidth because the cells are relatively small.

12 Claims, 9 Drawing Sheets

INTEGRATED TRAFFIC MONITORING ASSISTANCE, AND COMMUNICATIONS SYSTEM

FIELD OF THE INVENTION

The present invention relates to vehicular traffic, particularly on long distance high speed highways, monitoring of the traffic, providing assistance to drivers in the traffic based upon the traffic monitoring and communication with specific vehicles in the traffic. The communications may originate from a vehicle, for example, identifying the vehicle and its location, may be sent to the vehicle to provide driving assistance, or may be sent to and received from the vehicle, for example, as in telephone communications. Further, the system provides for prioritizing travel on a multiple lane highway and for adjusting tolls charged for the use of the highway.

BACKGROUND

Communication with vehicles on high speed, long distance highways, monitoring traffic on the highways, and monitoring the positions and speeds of specific vehicles on the highways present substantially difficulties. In conventional mobile communications systems, for example, mobile telephones, fixed antennas are installed in the vicinity of highways. Usually, these antennas are elevated, for example, located on the tops of towers or buildings, in order to provide a large area of communication with vehicles. Each fixed antenna at least partially defines a cell and in typical cellular telephone communication, communication shifts from antenna-to-antenna, as a mobile transmitter moves between cells, usually without the notice of the persons, mobile or fixed, who are communicating.

The relatively widely spaced fixed antennas for cellular communication along highways have limitations. For example, each cell has a limited bandwidth from which channels for communication can be assigned. Thus, if too many telephone calls are attempted within a single cell at the same time, all channels may be placed in use so that some potential callers will not be assigned channels and will be unable to establish communication.

If traffic on a highway is to be monitored, and particularly if speeds and positions of individual vehicles are to be determined, simultaneous communication with each of the vehicles on the highway is required. Each vehicle requires a channel for communication. Absent a complicated multiplexing scheme, the bandwidth needed for communication within a typical mobile telephone cell between all of the vehicles traveling on a high speed long distance highway and a fixed antenna readily exceeds the available bandwidth. Therefore, such traffic monitoring is not even theoretically feasible. The bandwidth problem cannot be solved by increasing the available bandwidth because of the number of channels that would be required and limited electromagnetic spectrum availability.

SUMMARY OF THE INVENTION

It is an object of this invention to solve the problem imposed by the limited bandwidth available for communication with vehicles, particularly vehicles on a multiple lane high speed long distance highway, so that communication can occur with a large number of vehicles without the necessity of increased bandwidth of the communications.

According to a first aspect, a traffic monitoring system includes lane terminals for detecting passage of a vehicle, a communication antenna, a terminal transceiver for communicating with a passing vehicle through the communication antenna, and a network backbone linking the lane terminals to a data processor for compiling information on passing vehicles sensed.

In a preferred arrangement, a traffic monitoring system for a highway includes first and second adjacent lanes for travel in the same direction, including a first line of the lane terminals located along an outside edge of the first lane, a second line of the lane terminals located between the first and second lanes, and a third line of the lane terminals located along an outside edge of the second lane, each of the first, second, and third lines of the lane terminals including respective network backbones connected the respective first, second, and third lines of the lane terminals.

It is particularly preferable that the system include at least one transverse link interconnecting the first, second, and third network backbones and a principal network backbone connected to the transverse link and providing an interconnection between the first, second, and third lines network backbones and the data processor.

The traffic monitoring system most preferable includes a traffic data base connected to the data processor through the principal network backbone for storing traffic information including passing vehicles detected by the sensor for processing by the data processor.

The traffic monitoring system provides for cellular communication with moving vehicles wherein groups of lane terminals define communication cells for communication with vehicles traveling on the highway and a cell management data base is connected to the data processor for identifying positions of specific vehicles on the highway with respect to the communication cells.

For increased utility, the traffic monitoring system may include a toll server connected to the principal network backbone and receiving information from the lane terminals for determining a toll of a vehicle traveling on the highway based upon the lane traveled by the vehicle.

For greatest utility, the traffic monitoring system includes mobile transceivers mounted on respective vehicles for sending signals to the lane terminals identifying the respective vehicle on which a transceiver is mounted.

Simpler systems may omit communication antennas in the lane terminals or vehicle sensors in the lane terminals.

BRIEF DESCRIPTION OF THE DRAWINGS

In all figures, like elements are given the same reference numbers.

DESCRIPTION OF PREFERRED EMBODIMENTS

In the invention, the problem of limited bandwidth of relatively widely spaced antennas, each antenna covering a large area for communication with vehicles, is solved by providing a relatively large number of fixed short range transceivers. The transceivers include transmitters with relatively short ranges as compared to the range of conventional cellular telephone communication antennas. The transceivers are located relatively close to each other along and within a highway so that the distance between a vehicle and an antenna of a transceiver is very short compared to the average distance between a vehicle and a conventional cellular telephone fixed antenna. Because the transmitting range of the transmitter part of the transceivers is short and the transmitter is relatively close to vehicles, each transmitter can reach only a few vehicles at one time. Accordingly, communication channels can be repeatedly used in relatively close proximity, especially compared to the separation distances between adjacent antennas in a conventional cellular telephone system. Thus, the available bandwidth for communications between the vehicles and specific transceivers is rarely, if ever, exceeded.

Lane Terminals

Figure 1:
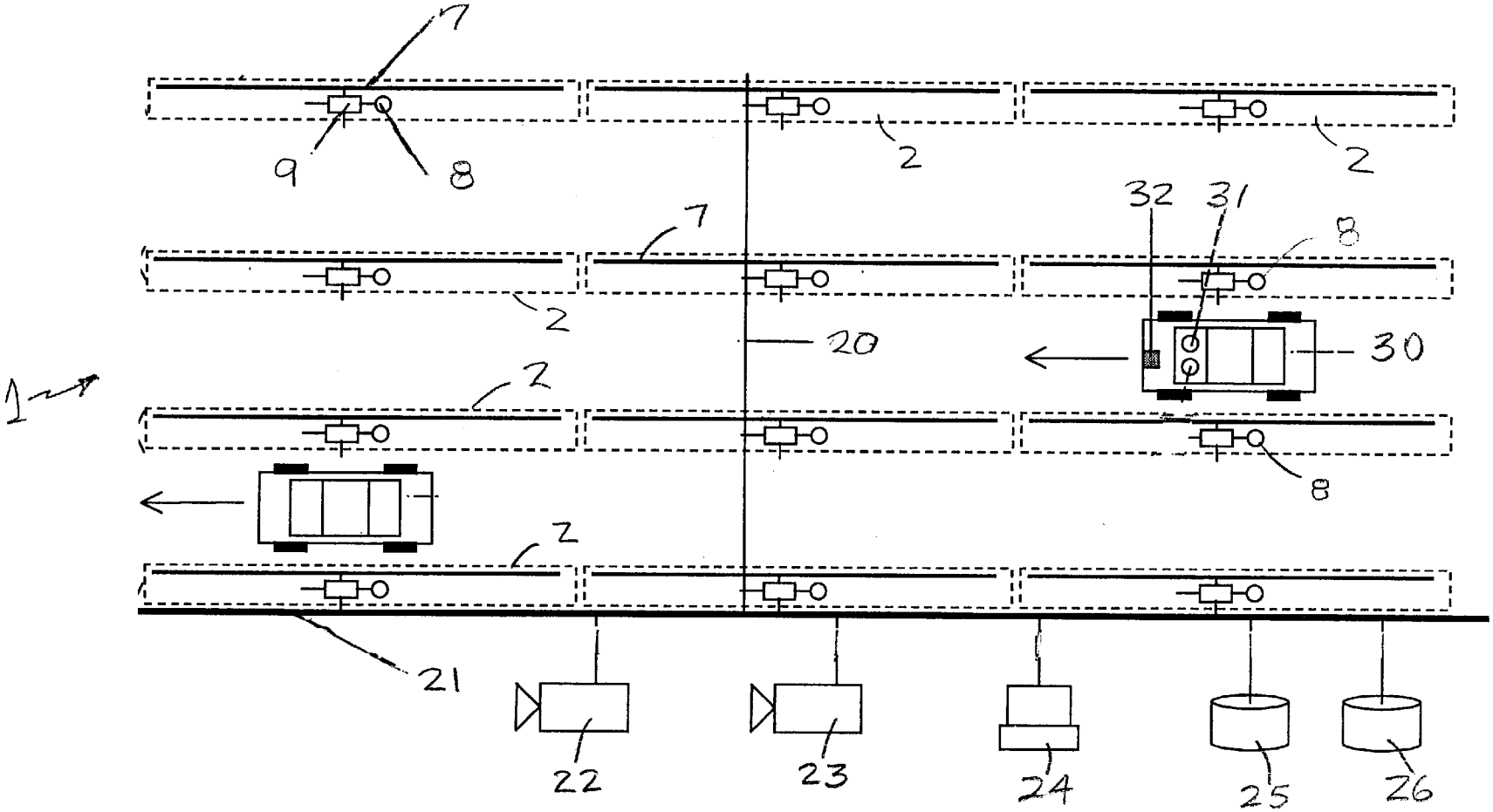
FIG. 1 is a schematic plan view of a portion of a highway including an integrated traffic monitoring, driver assistance, and communication system according to an embodiment of the invention.
Figure 2:
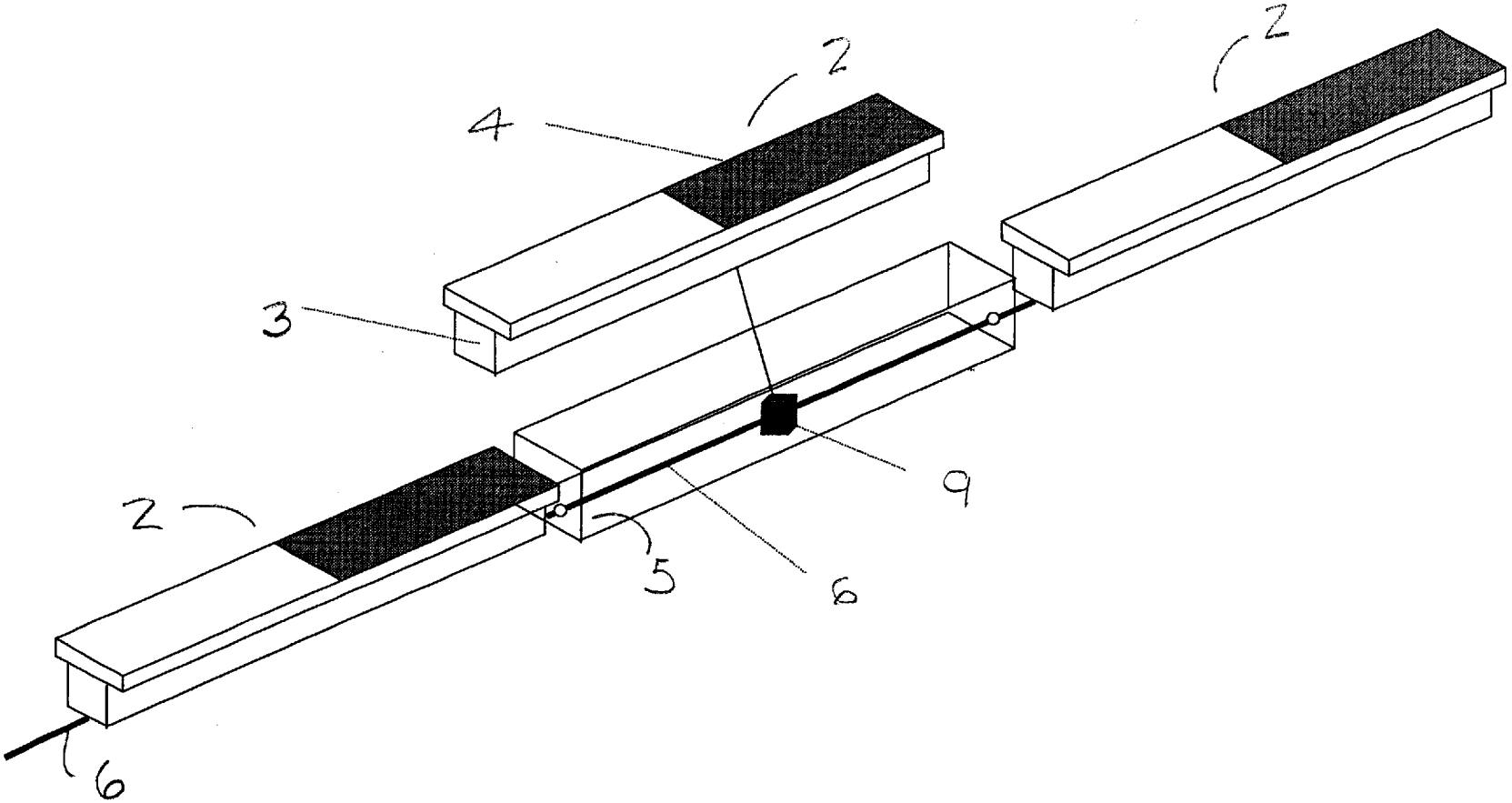
FIG. 2 is a perspective view illustrating serially arranged lane terminals according to an embodiment of the invention.
Figure 3:
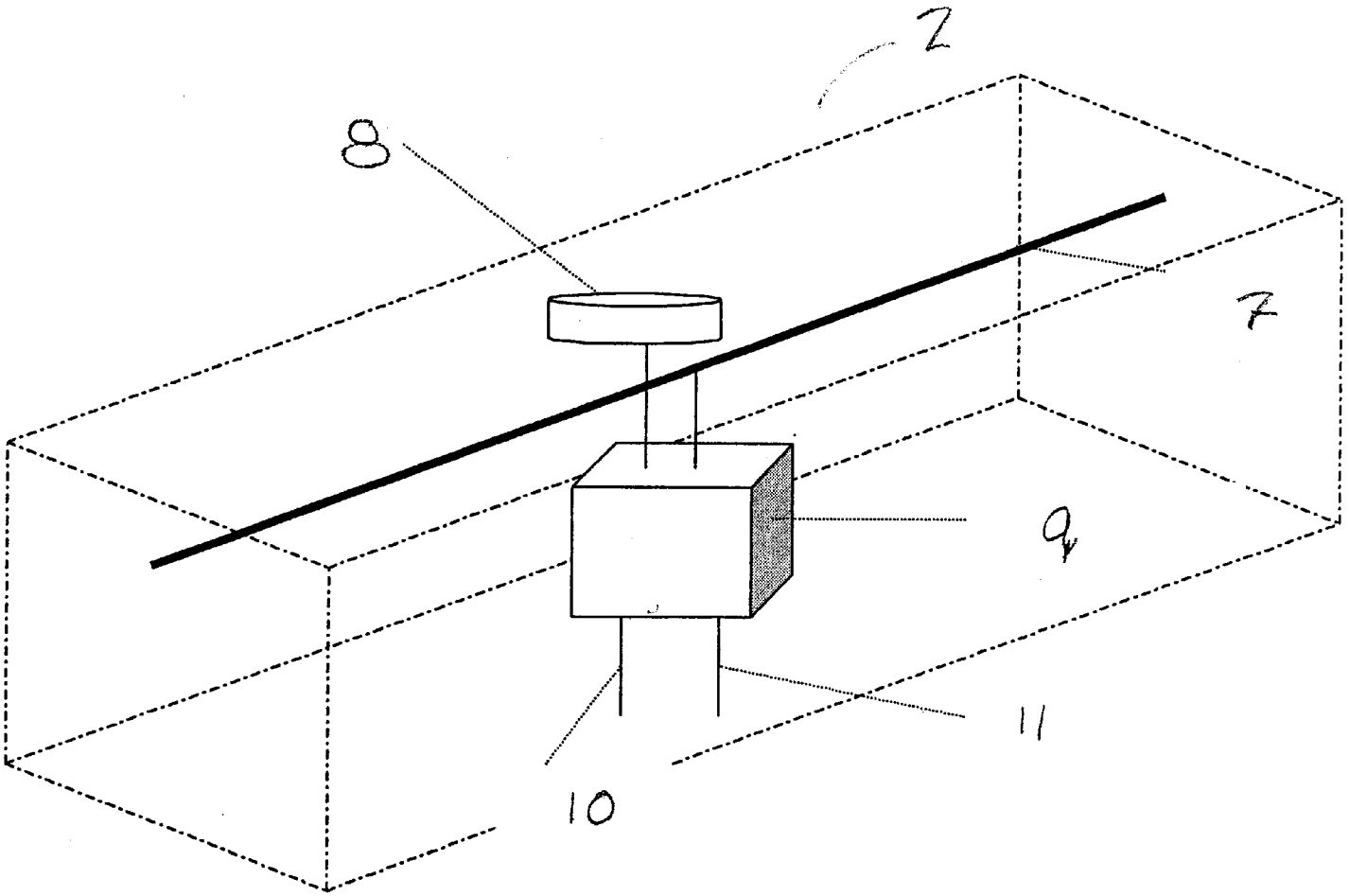
FIG. 3 is a more detailed view of a single lane terminal according to an embodiment of the invention.

FIG. 1 is a schematic plan view of a portion of one-half of a highway 1 including three lanes in which traffic moves in the same direction, i.e., to the left in FIG. 1. At each margin of the highway 1 and between each of the pair of adjacent lanes of the highway 1, lines of a plurality of lane terminals 2 are longitudinally arranged. As used here, "longitudinal" means that the lane terminals are aligned with the direction of travel on the highway 1. As shown in FIG. 1, the lane terminals are arranged end-to-end in each line. An arrangement showing three of the lane terminals 2 positioned end-to-end is illustrated in FIG. 2. FIG. 3 shows a single lane terminal 2 in greater detail. Preferably, each lane terminal 2 has a length of tens of meters, for example, from ten to thirty meters, and is relatively narrow, for example, thirty to sixty centimeters. These dimensions permit ready installation of the lane terminals in a highway.

Each lane terminal, as shown in FIG. 2, includes a box or package 3 having an open top closed by a cover 4. The box 3 is received in a vault 5 prepared in the road or at the side of the road so that the cover 4 is, preferably, level with the surface of the road and is not a raised barrier nor a depression that may pose a danger to a driver. As shown in FIG. 2, each of the lane terminals 2 in a line is linked by a network backbone 6 that extends along and, possibly, through, the lane terminals. Within each of the boxes 3 of the lane terminals, there are included, as best shown in FIG. 3, an antenna 7, preferably extending along and nearly the length of the lane terminal, a vehicle sensor 8, preferably including a loop antenna, and a communication node 9. Preferably, the antenna 7 is a linear antenna, for example, a leaky coaxial cable antenna, for providing short range communications over a relatively long length, i.e., at least the length of the lane terminal. However, other types of antennas that are not elongated may be used as the antenna 7 as well. The vehicle sensor 8, which includes circuitry in the common communication node 9, responds to the nearby passage of a vehicle or like metallic object by generating a signal, i.e., a pulse, that is relatively easy to detect. The communication node 9 includes a transceiver for transmitting and receiving information, through the antenna 7, from and to a remote site through the network backbone 6. Likewise, the communication node 9 supplies information from the vehicle sensor 8 to a remote site. The communication node receives power from power lines 10 extending along, and, possibly, through, the lane terminals. The communication node 9 is connected to the network backbone 6 through a line 11. The network backbone 6 is preferably an optical fiber communications link capable of carrying a large quantity of information simultaneously. Thus, the communication node 9 includes circuitry for converting optical signals into electrical signals and for the reverse transformation in order to receive information and instructions optically and to provide an optical output.

Returning to FIG. 1, it is apparent that each of the lines of lane terminals 2 includes a separate network backbone 6. These network backbones are connected to a traffic monitoring and communications center that may be remote from the highway where traffic monitoring is occurring. The respective network backbones 6 may be connected to each other at various locations by transverse links 20, as illustrated in FIG. 1. Each transverse link 20 extends transverse to the lines of the network backbones 6 of a similar position across the lanes and interconnects the respective network backbones. The transverse links 20 may provide connection of all the network backbones to a principal network backbone 21 that supplies information gathered in regions of the highway 1 to the traffic monitoring and communication center remote from some or all of the highway region being monitored. The arrangement of transverse links 20 enables the network backbones 6 alongside the traffic lanes to be of limited length, i.e., segmented, while the principal network backbone 21 is the only longer, continuous length communications line.

Connections to the principal network backbone are not limited to the lane terminals with their respective vehicle sensors and communication antennas. In addition, to the lane terminals, video cameras, such as the cameras 22 and 23 shown in FIG. 1, may be connected to the principal network backbone 21 in order to supply video images of highway traffic. Of course, the video cameras may be less effective than the radio communication system described here, since the video images are subject to deterioration depending upon lighting and weather conditions. At least one computer 24 is also connected to the principal network backbone, either at various regions along the highway being monitored or at the remote monitoring and communication center for processing of he data supplied by the lane terminals and for providing information and commands to the lane terminals. As described in more detail below, the computer is a data processor that may track the locations and speeds of vehicles traveling on the highway and may regulate other functions of the system. Among those functions are compiling of information concerning vehicles, processing information that is stored in a cell management data base 25, and maintaining and analyzing data in a traffic data base 26, each of which is connected to the principal network backbone 21.

Vehicle Transceivers and Position Detection

Figure 4:
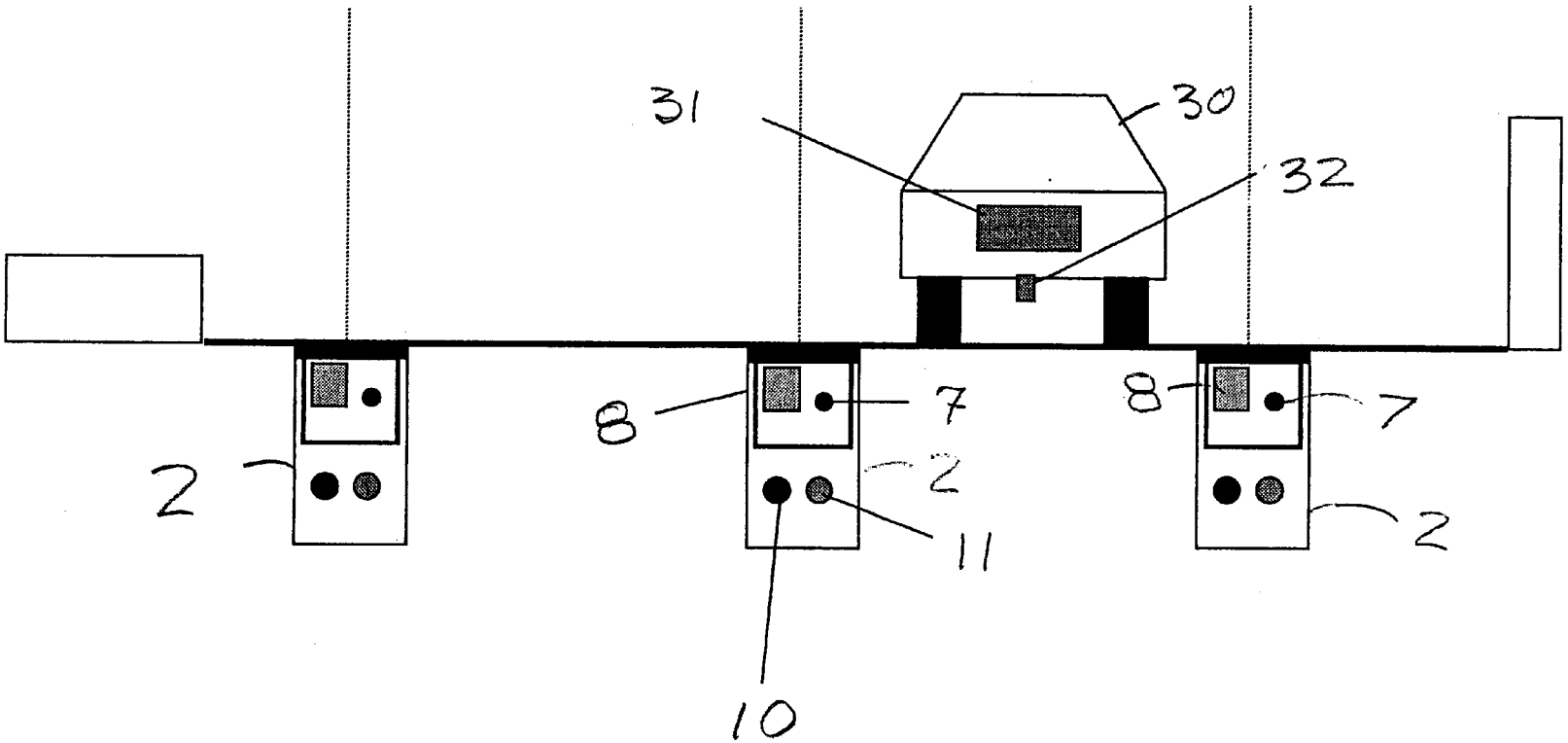
FIG. 4 is a cross-sectional view of a highway including an integrated traffic monitoring, driver assistance, and communications system according to an embodiment of the invention.

In order to make the system fully effective, vehicles traveling on the highway including the system are preferably equipped with a transceiver 31 as schematically illustrated in FIG. 4. There, a vehicle 30 includes the transceiver 31 connected to an antenna 32, preferably extending from beneath the vehicle so that the antenna 32 is relatively close to the antennas 7 of the lane terminals 2 and not blocked by the vehicle itself. As shown in that FIG. 4, when, as preferred, the lane terminals 2 are located between adjacent pairs of lanes, the antenna 32 of a vehicle within a lane is always relatively close to two of the lane terminals.

Vehicle 30 is also schematically illustrated in FIG. 1 between a pair of lane terminals 2 and passing between the respective vehicle sensors 8 of those lane terminals. Each transceiver 31 in a vehicle is arranged to transmit, as requested, for example, by a signal sent by the nearest lane terminals in response to sensing of the presence of the vehicle by the sensors 8, a vehicle identifying signal. Thus, the transceiver 31 may function as a transponder producing vehicular identifying information that is received by the antennas 7 of each nearest lane terminals 2, the same antennas from which corresponding interrogating signals have been transmitted. The vehicle identification information, uniquely assigned to each vehicle, provides reference information, establishing the location of the vehicle. A similar transponder interaction occurs at each pair of lane terminals on opposite sides of the lane in which the vehicle is traveling. Moreover, since the distance between end-to-end lane terminals in a line and their respective vehicle sensors is well established, the speed of the vehicle can be determined from the time difference between the transponding events at lane terminals along one or more lines of the lane terminals. Moreover, the lateral position of the vehicle, i.e., the lane in which it is traveling, is readily determined since each of the lane terminals is likewise uniquely identified as to its position.

Of course, the passage of vehicles may be sensed by vehicle sensors 8 that are present in lane terminals not adjacent to the passing vehicle. However, by employing comparisons of signals transmitted from the vehicle and received at respective lane terminals, the lane terminals closest to the vehicle can be determined. For example, a comparison of signal strengths or the phases of the signals received from the vehicle through the antenna 32 can be used to eliminate spurious signals from lane terminals not adjacent to a vehicle. The vehicle position and speed information may be transmitted through one of the transverse links 20 to the principal network backbone 21, received at and processed by the computer 24, and stored in at least one of the data bases 25 and 26. As described below, this information can be used for a variety of purposes. In all instances, time is an important factor in obtaining useful information for real time use or historical analysis. Thus, each lane terminal records the time a vehicle is sensed by the sensor 8 and the time of other traffic monitoring transactions and includes time data in the traffic information sent for processing in the computer 24 at the monitoring site.

Alternative Vehicular Position Sensing

A useful application of the system concerns establishing the position of a particular vehicle along a lane and within a lane. Each lane terminal may transmit a signal, in addition to signals for mobile communication, that is unique for the particular margin of a particular lane. In other words, the signal uniquely identifies the position on the highway of the lane terminals relative to the lanes of the highway. A vehicle with a transceiver or receiver can determine its precise position along a highway from the unique identification information broadcast by the lane terminals. Using one or more antennas mounted on the vehicle, the lateral position of the vehicle, i.e., the distances from the antenna to the two lane edges nearest the vehicle, can be determined. Using this feature, a vehicle can determine its lateral position relative to the boundaries of the lanes, to maintain that position. Changing of lanes or incursion into an adjacent lane may trigger an alarm. Alternatively, the lateral position can be passively determined for transmission to a central traffic control and monitor. Mechanisms for these determinations are now described.

Figure 5A:
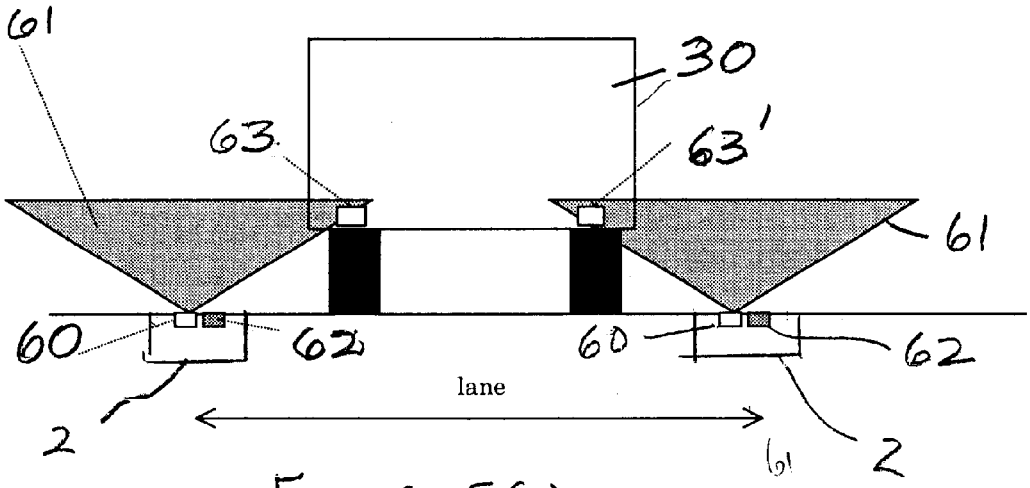
FIGS. 5(*a*) and 5(*b*) illustrate a lateral position detecting apparatus according to an embodiment of the invention.
Figure 5B:
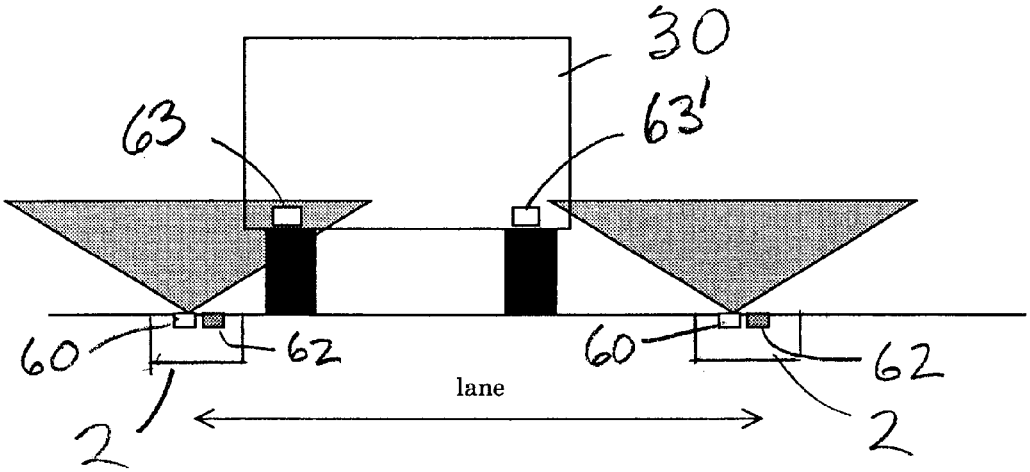
Figure 6A:
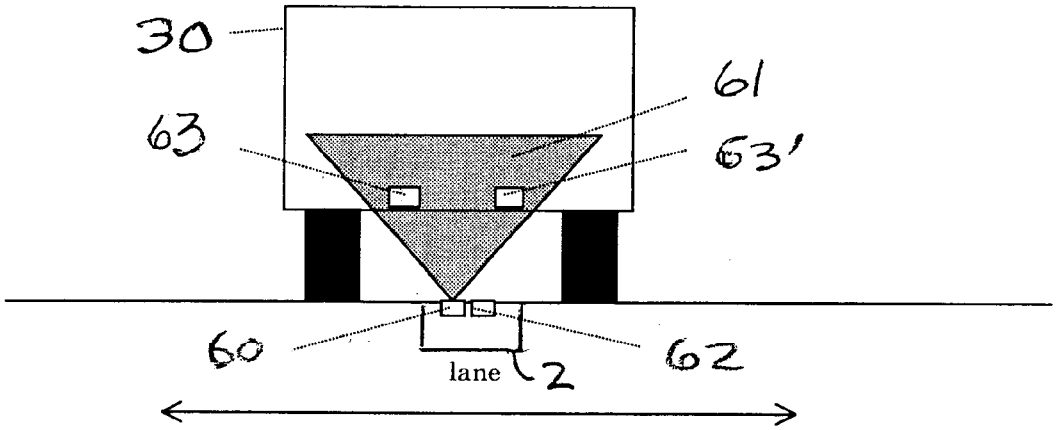
FIGS. 6(*a*) and 6(*b*) illustrate an alternative lateral position detecting apparatus according to an embodiment of the invention.
Figure 6B:
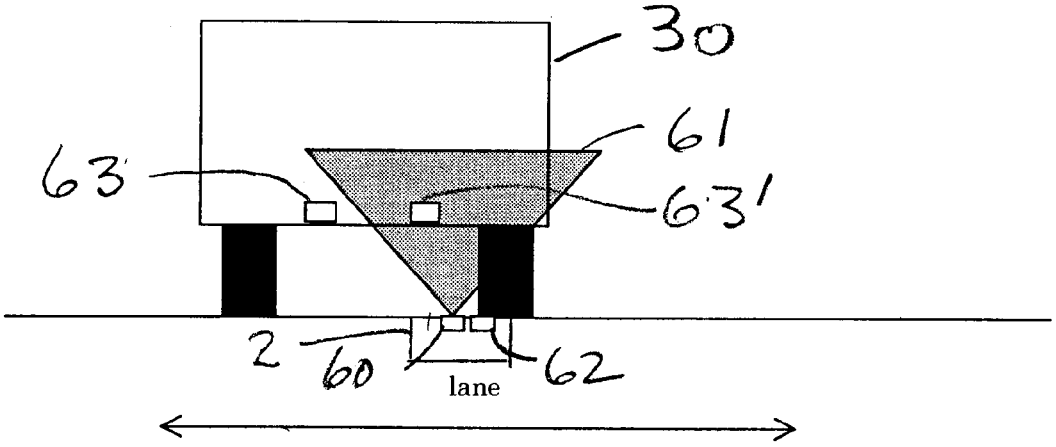

Two alternative embodiments for detecting lateral positioning are illustrated in FIGS. 5(*a*) and 5(*b*) and in FIGS. 6(*a*) and 6(*b*). In the apparatus employed in these examples, millimeter radio waves, i.e., having frequencies ranging from about 50 to about 80 GHz, are employed. At these frequencies, the signals are highly directive so that the electromagnetic waves may be focused into a narrow beam. For example, in some vehicular radar devices, the beam may have an angle of only one or two degrees.

As shown in FIG. 5(*a*), each lane terminal 2 includes a millimeter wave transmitter 60 producing a beam 61 of electromagnetic waves, and a millimeter wave receiver 62. As described below, the apparatus can be entirely passive, i.e., the vehicle 30 does not need to include any receiver or transmitted. In another embodiment, the vehicle includes two receivers 63 and 63' spaced from each other and arranged on the vehicle to interact with the lane terminals 2 located at the boundaries between adjacent lanes.

In the arrangement illustrated in FIG. 5(*a*), a cross-sectional view similar to FIG. 4, the vehicle 30 is in the center of the lane. The beams 61 of the respective millimeter wave transmitters 60 are sufficiently wide so that the transmitters 60 send respective signals that reach the vehicular-mounted receivers 63 and 63'. With both of the vehicular-mounted receivers 63 and 63' receiving signals, the operator of the vehicle can be informed that the vehicle is centered within the lane. When the vehicle 30 drifts laterally toward one of the lane boundaries, for example, toward the left as shown in FIG. 5(*b*), receiver 63' no longer is in a position to receive the millimeter waves whereas the receiver 63 continues to receive those waves. By comparing the signals produced by the two receivers 63 and 63', the relative location of the vehicle within the lane can be determined. While FIG. 5(*b*) illustrates movement of the vehicle 30 to the left, a similar result occurs, although inverted with respect to the vehicular-mounted receivers 63 and 63', when the vehicle 30 moves sufficiently to the right from the center of the lane. This arrangement clearly also provides for the detection of a lane change.

Although the foregoing example presumes that two receivers 63 and 63' are mounted on the vehicle 30, a similar positioning apparatus may be passive in order to provide lateral positioning information to a central location without providing the information to the vehicle operator. In that arrangement, the receivers 61 in the lane terminals sense reflected millimeter waves transmitted from the corresponding transmitter 60 in the lane terminals. Those reflected waves are produced by vehicles passing nearby and sufficiently close to the lane terminals to intersect the transmitted narrow millimeter wave beams. This passive system is somewhat analogous to conventional radar.

In FIGS. 6(*a*) and 6(*b*), an alternative to the arrangement of FIGS. 5(*a*) and 5(*b*) is illustrated. In this arrangement, the lane terminal 2 is located centrally within a lane. This alternative may reduce costs by saving some lane terminals that would be present if lane terminals are located at each boundary between adjacent pairs of lanes. As illustrated in FIG. 6(*a*), when the vehicle 30 is relatively centrally located within a lane, both of the receivers 63 and 63' on the vehicle receive signals of the single transmitted millimeter wave beam. However, when the vehicle 30 moves significantly within the lane, for example, to the left as illustrated in FIG.

6(*b*), only the receiver 63' receives the relatively narrow beam signal. The loss of the signal at receiver 63 indicates the lateral movement of the vehicle relative to the center of the lane. A similar but inverse effect is experienced if the vehicle moves to the right, rather than to the left as illustrated in FIG. 6(*b*).

The arrangement with the lane terminals in the center of the lane as illustrated in FIGS. 6(*a*) and 6(*b*) can likewise be used to passively determine the passage of a vehicle. As in the passive detection described with regard to FIGS. 5(*a*) and 5(*b*), the passage of a vehicle causes reflection of the millimeter waves and their detection by the receiver 62 within the lane terminal 2. However, with the central lane location of the lane terminal 2, the lateral location of the vehicle cannot be determined since only a single reflection is detected, not more than one simultaneous signal detection.

Figure 7:
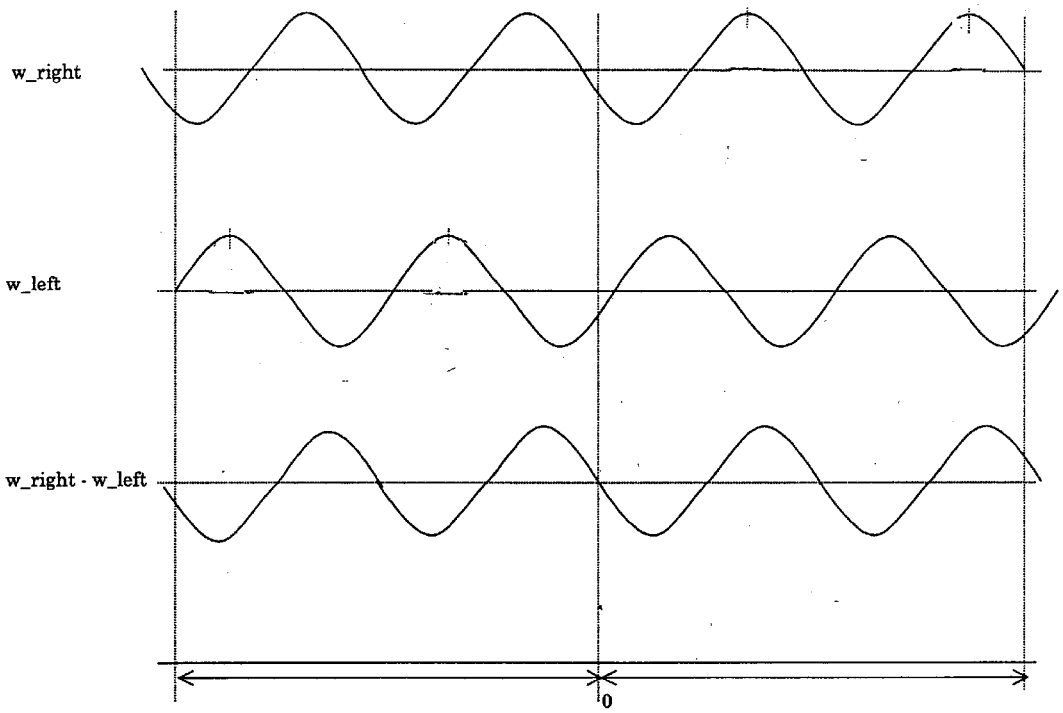
FIG. 7 is a graph showing signals in a lateral position detecting apparatus according to the invention.

Although the arrangements illustrated with respect to FIGS. 5(*a*)–6(*b*) enable a general determination of the lateral position of a vehicle with respect to a lane, if more precise lateral position information is required, a more sophisticated position determining technique may be used. For example, one technique, similar to the Global Positioning System, that employs lane terminals at boundaries between each pair of adjacent lanes determines position from the phase difference between synchronized radio waves transmitted from lane terminals on opposite sides of the lane. FIG. 7 is a graph illustrating an example of this technique. The abscissa represents position within a lane between the two lane terminals at the margins of the lane. The uppermost curve indicates a continuous signal transmitted from the lane terminal at the right edge of the lane. Typically, the frequency of the signal may be 2.4 GHz, a frequency used in commercial wireless local area networks. This signal is designated w_right. The middle curve of FIG. 7, the signal w_left, represents a signal propagating from the lane terminal at the left edge of the lane. The two signals w_right and w_left have a constant phase relationship. The lowest curve in FIG. 7 is the difference between the two signals w_right and w_left. This difference signal does not change with time because of the constant phase relationship between the two other signals. The amplitude of the difference signal can be determined at a vehicle with appropriate signal processing and analysis equipment. That amplitude has a zero value when the vehicle is exactly centered in the lane and varies between maximum and minimum values with a period determined by the frequency of the transmitted signals at points different from the center of the lane. The difference signal is determined from signals received by two receivers on the vehicle and the difference signal is processed by a computer to detect amplitude and phase so that the position of the vehicle laterally within the lane is precisely determined.

Cellular Communication

The system is capable of monitoring and communicating with a large volume of traffic because of the short range of the communications between each vehicle and the lane terminals on opposite sides of the vehicle. In essence, each such pair of lane terminals defines a cell, similar to a cell of a cellular telephone. However, because the broadcast range of the communication node 9 and the transceiver 31 are relatively short, relatively few vehicles can be considered to be present in the same cell at the same time. A cell is not necessarily limited to two lane terminals on opposite sides of a lane but may include several such lane terminals in the direction of travel of vehicles as well as transverse to the direction of travel of the vehicles. Even when many lane terminals are considered as a group, i.e., one cell, because the number of vehicles present in any single cell at any given time is limited, the total bandwidth, i.e., number of channels, available for each cell will not be exceeded. Only a few channels are needed for each cell and those channels may be reused in nearby cells without interference because of the short range of communication. In other words, far more efficient use of the radio frequency spectrum is achieved in the invention using relatively small cells with a very large number of antennas as compared to the conventional cellular communication telephone system using much larger cells and far fewer antennas. The cell size and definition, which need not be uniform, is controlled and monitored by the cell management data base 25.

The communication between the lane terminals and vehicles having transceivers is easily established using known technology. For example, wireless local area network technology standard systems may be used. Examples are those of IEEE Standards 802.11 and 802.1 lb. This standard provides a relatively short maximum range that is long enough for the present invention. Bandwidths according to these standards are 2 Mbps and 11 Mbps, more than sufficient for practice of the invention with a busy highway. Moreover, these standards provide for "hand-off" when a mobile transceiver moves from one cell to another cell, i.e., from communication with one fixed antenna to communication with another fixed antenna, the fixed antennas being located in lane terminals in embodiments of the invention.

Although vehicles containing transceivers or transponders have been described, in order to determine the speed of a specific vehicle and its passage, it is not essential to the system that a vehicle include such a transceiver. Rather, the vehicle sensors 8 are sensitive to the passage of any vehicle, even if the vehicle cannot be identified from a signal transmitted by the vehicle, and the speed of the vehicle can be calculated based upon the time difference between sensing of the vehicle at pairs of lane terminals arranged in a line, end-to-end, on opposite sides of a lane. However, if a vehicle includes a transceiver, many additional functions can be realized by the system.

One example of the use of the system is in cellular communication. Each mobile terminal on a vehicle sends and receives polling messages to and from the cell management data base 25 connected to the principal network backbone 21 that, in turn, is connected to the lane terminals by the respective lane network backbone 6 and the transverse links 20. When a node, either on a vehicle or at a fixed location, wishes to communicate with a mobile transceiver on a vehicle, the position, i.e., cell, of the mobile transceiver will be identified by making an inquiry to the cell management data base 25. The inquiry may use, for example, the Internet protocol address assigned to the mobile transceiver if the system network is connected to the Internet, as a search key. Alternatively, different identifying codes, uniquely identifying each mobile transceiver, can be used to locate the cell containing a mobile transceiver of interest to establish communication in the same manner that communication is presently established in cellular telephone systems. The difference from the conventional cellular telephone arrangement is in the size and number of the cells and the precision with which the location of a vehicle is determined. Although the cell management data base 25 is shown in FIG. 1 as being at a single location connected to the principal network backbone 21, in fact, particularly when there is a large volume of data to be processed and stored, i.e., where a highway being monitored extends over a long distance, the cell management data base may consist of numerous such sub-data bases or duplicate cell management data bases located at several locations. In any event, when the mobile transceiver is identified, communication is established as in conventional cellular telephone systems, with cell-to-cell switching, as the vehicle travels on the highway. The novel system differs from the conventional system in that two-way communications can be established with a very large number of vehicles simultaneously without exceeding the bandwidth available for cellular telephone communications because of the short range of communication, i.e., the small size of the cells, and the resultant efficient bandwidth usage.

Compilation of Traffic Information

In a further application, as already explained, the speed of a vehicle can be determined by measuring the time elapsed between passage of a vehicle along two adjacent end-to-end lane terminals. When the vehicle includes a transceiver or transponder, uniquely identifying the vehicle, the position information of specific vehicles can be sent to the traffic data base 26. For vehicles without transceivers or transponders, the number of vehicles passing particular locations as a function of lane and time can also be determined and sent to the traffic data base 26. There, traffic information can be compiled. The current density of traffic in various areas of the highway can be determined to provide information and assistance to drivers as described below. Changing traffic density and traffic patterns can be obtained from mathematical analysis of the traffic data base 26 for real time traffic monitoring and for later analysis of historic traffic patterns to provide improvements in transportation and traffic regulation. As with the cell management data base 25, the traffic data base 26 may be located in a single location or distributed among a plurality of data base memories located at various locations along a highway or at a remote traffic monitoring center.

Driver Assistance

In addition to the applications of the novel system already described, the invention can be employed to assist drivers of vehicles by providing information that could not otherwise be obtained by the drivers. The driving assistance information can be derived from the lane terminals themselves or from a central traffic monitoring station using the traffic data base 26. As already described, the traffic data base 26 collects information on the current locations of vehicles, their speeds, the density of traffic, and like information. This information can be analyzed and information from the analysis can be transmitted through the lane terminals to a vehicle equipped with a transceiver. For example, a display may be provided in a vehicle showing the locations of the closest other vehicles. Information on the locations, lanes, and speeds of the nearby vehicles is available from the traffic data base. Accordingly, a driver can be warned concerning an approaching speeding vehicle, possibly endangering the vehicle receiving the information. The location of nearby vehicles can supply information assisting a driver in attempting to change lanes by warning of danger of a collision with other vehicles in making the lane change. A driver can be warned of too rapid an approach toward a vehicle ahead.

Figure 8:
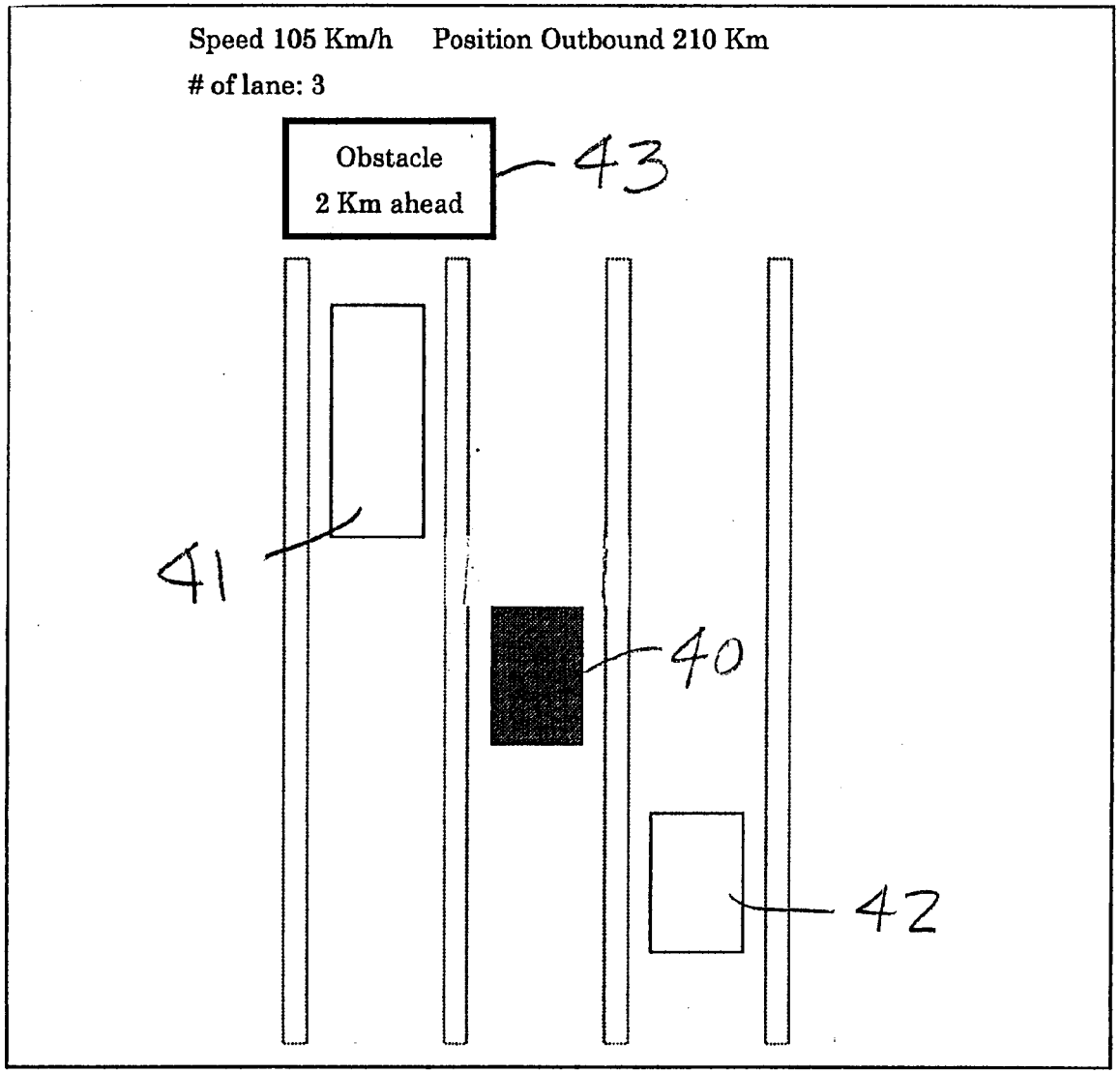
FIG. 8 is a schematic plan view of a driver assistance system according to the invention.

An example of a graphical display of driver assistance information is illustrated in FIG. 8. There, the driver's own vehicle 40 is shown in a particular lane and other vehicles 41 and 42 in adjacent lanes are illustrated. While no other vehicle is shown in the same lane as the vehicle 40 in which the display is present, warnings can be provided if the driver is approaching a vehicle ahead too rapidly, posing a risk of collision as well as indicating the approach from behind of a vehicle that also may be moving at a speed that raises the possibility of a collision. In addition, as illustrated by the indicator 43 in FIG. 8, the display may include a warning of traffic congestion, an accident, or another obstacle ahead, notifying a driver well in advance of approaching the scene of a delay and enabling avoidance of the obstacle. The information identifying the existence of such an obstacle, including traffic congestion, is obtained from the traffic data base 26 and periodically transmitted via the lane terminals to vehicles equipped with driver assistance apparatus. The information used to provide the display can even be used to effect steering and/or braking of a vehicle to avoid a collision.

The traffic data base 26 may be employed not only to provide real time information in a graphic display, as in FIG. 8 or in another form, but also to compile historical information. To assist analysis of that historical information in addition to the vehicular identification, location, and speed information gathered, environmental information, such as temperature, precipitation, and road condition over time, and even video streams obtained from the television cameras 22 and 23 may be stored for later analysis.

Prioritization of Lane Usage

Figure 9:
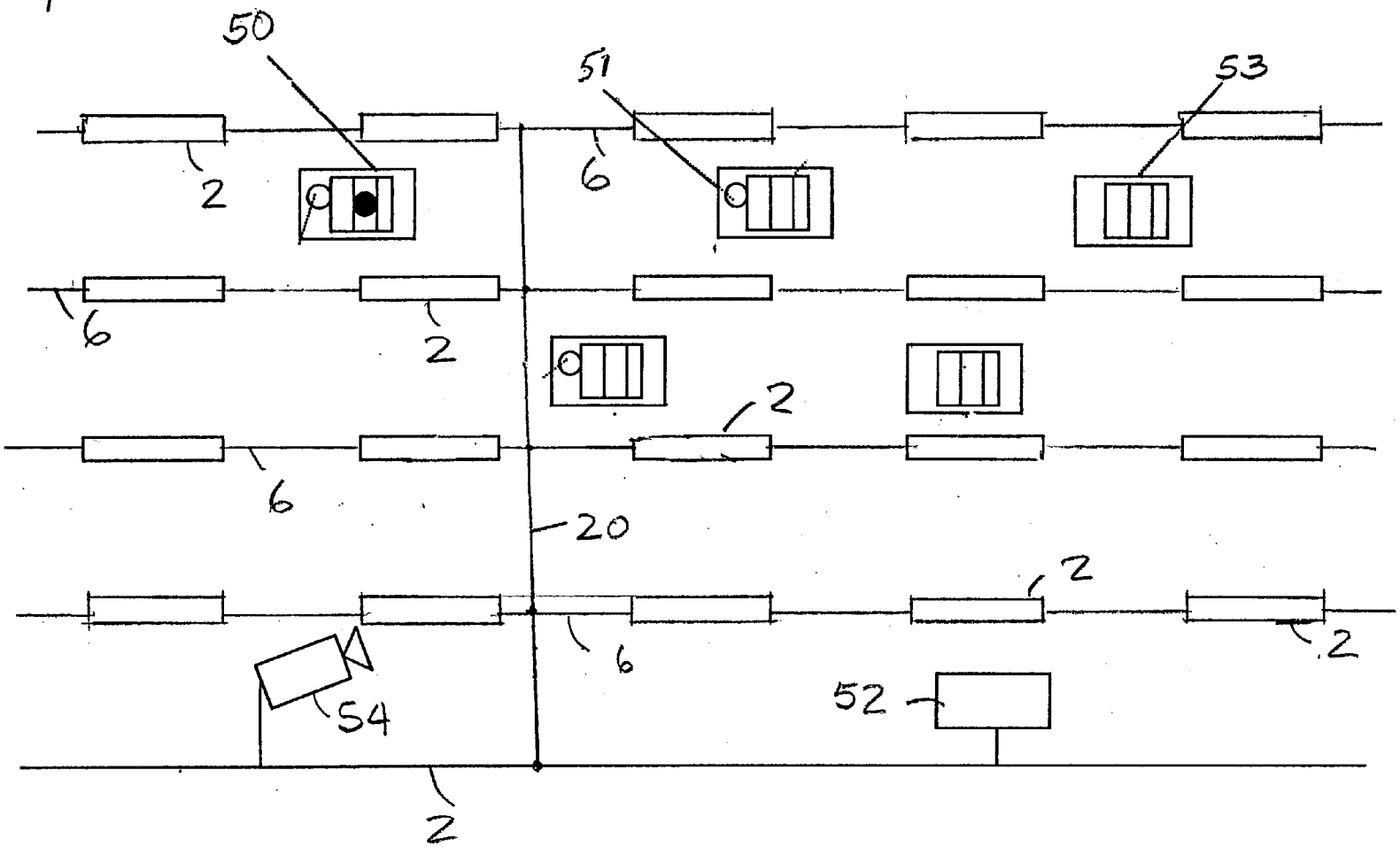
FIG. 9 is a schematic plan view of a highway illustrating another application of a system according to the invention.

In applications of the invention previously described, all vehicles equipped with transponders or transceivers have, essentially, equal status. However, a prioritization system can be established through particular identification codes of vehicular transponders. An example of such an application is illustrated in FIG. 9. In that plan view of three lanes of a highway, a lane 45 is given the highest priority, i.e., has the highest speed of travel. A center lane 46 of the three lanes is a lower speed travel and lower priority lane. Finally, lane 47 is the lowest speed and priority lane.

Traffic can be prioritized in these lanes 45, 46, and 47 based upon public interest, purpose of travel, and other considerations. For example, as shown in FIG. 9, a vehicle 50 may be an emergency vehicle, such as a police car, an ambulance, or the like. The transponder in this vehicle 50 broadcasts a code identifying the emergency character of the vehicle, providing authority for its presence and travel in the highest priority lane. Assuming the highway is a toll road, the emergency vehicle may be excused from paying any toll or may pay a standard or reduced toll for traveling in the highest priority lane, lane 45.

Vehicle 51 may be a commercial delivery vehicle, such as an overnight courier that seeks high speed travel to meet its commercial needs. The operator of this vehicle is authorized to use the fastest lane 45 because he pays a premium toll in order to use the highest priority lane 45. Therefore, the transponder in this vehicle 51 emits a code identifying the operator of the vehicle and a surcharge on the usual toll is exacted for use of the highest priority lane. Of course, if the vehicle 51 chooses to travel in a lower priority lane, such as lane 46, then a smaller surcharge on the toll may be made and no surcharge at all may be made upon travel in the lowest priority lane, lane 47. Vehicle 51 might also be a multiple passenger public vehicle, such as a bus. An incentive to use multiple passenger public transportation might be given by making a reduced or no surcharge to the bus operator for using higher priority lanes just as no surcharge might be made for emergency vehicles in the highest priority lanes. This savings may reduce fares, encouraging buses and like vehicles to reduce traffic congestion.

Flexible Toll Assessment

The tolls and surcharges, if any, for using the highway and it hierarchy of lanes may be made automatically through the system illustrated in FIGS. 1 and 9. The vehicle 51 is identified at each lane terminal, the lane position is determined by the vehicle sensor and the transceiver at the corresponding lane terminal, and information concerning the vehicle distance traveled and lane position is sent via the lane terminal network backbone 6, the transverse link 20, and the principal network backbone 21 to the traffic data base 26 or to a toll server 52 dedicated to charging tolls (shown schematically in FIG. 9). The availability of data concerning the location, travel distance, and travel time of particular vehicles provides many choices for toll collection, incentives, regulation, and management. For example, tolls might be adjusted depending on the day and time of travel of a vehicle to make time use of the highway more uniform and to reduce congestion. Surcharges may be made for priority travel or discounts might be offered for long distance travel. In addition, where expected service, such as a minimum speed of travel, is not achieved, a toll might be subject to a discount. The system allows tracking of the position of vehicles so that any discount for an unexpectedly low average travel speed may not be obtained simply by stopping during travel, for example, at rest areas. These toll adjustments can be structured to provide an incentive for equipping vehicles with an identifying transceiver.

Vehicles without transceivers identifying the vehicle cannot be monitored reliably for toll variation purposes and have to pay a flat toll without any discount for delays, low priority lane travel, and the like and could be subject to surcharges for unauthorized use of priority lanes. Of course, a vehicle, such as vehicle 53, that is not equipped with a transponder cannot be specifically identified electronically, but unauthorized use of the highway can still be detected. The existence of such a vehicle can be determined from detection by the vehicle sensors 8 in the lane terminals 2. The absence of an identifying signal from a mobile transceiver, taken in combination with detection of the presence of the vehicle, identifies a potentially unauthorized vehicle and its location. This information is supplied from the lane terminal 21 through the transverse lines 20 to the principal network backbone 21 (shown in FIG. 1) to the server 52. Especially when such an unknown vehicle is detected in a high priority lane, the server 52 triggers a video camera 54 to photograph the unauthorized vehicle 53 so that appropriate regulatory action can be taken.

The system has generally been described with lane terminals at the edge of a highway and between adjacent pairs of lanes. However, lane terminals can be placed at the centers of the lanes, as illustrated in FIGS. 6(*a*) and 6(*b*). The center lane placement reduces the number of lane terminals, reducing cost, but may result in some loss in precision in determining vehicle locations. For example, lane changes may be less rapidly and accurately detected. Thus, in the simplest possible system according to the invention, a single line of lane terminals may extend along the center of a single lane highway (for travel in one direction), providing all of the advantages described except lane change information, prioritization of travel, and flexible toll charges.

In the examples described, lane terminals are shown arranged end-to-end, continuously. However, gaps between lane terminals in the same lane or lane margin may be provided. For example, at least every other lane terminal shown may be omitted, as indicated in FIG. 6. The significant cost savings results in loss of precision of positioning information and an increase in the size and reduction in the number of communication cells. The reduction in the number of lane terminals is limited by avoiding an increase in cell size that would unduly increase the bandwidth needed for cellular communications, considering traffic density, so that no caller is denied access for lack of an available channel in the bandwidth provided.

The invention has been described with respect to particular embodiments. However, additions and modifications within the spirit of the invention are encompassed within the invention as defined by the following claims.

What is claimed is:

1. A traffic monitoring system for a highway including first and second adjacent lanes for travel in the same direction, the traffic monitoring system comprising:

a plurality of lane terminals arranged along directions of travel of the highway and including a first line of the lane terminals located along an outside edge of the first lane, a second line of the lane terminals located between the first and second lanes, and a third line of lane terminals located along an outside edge of the second lane, each lane terminal including a sensor for detecting passage of a vehicle;

a communication antenna;

a terminal transceiver for communicating with a passing vehicle through the communication antenna; and a network backbone linking the lane terminals to a data processor for compiling information on passing vehicles sensed, each of the first, second, and third lines of the lane terminals including respective network backbones connected to the respective first, second, and third lines of the lane terminals.

2. The traffic monitoring system according to claim 1 wherein the communication antenna is a linear antenna extending along a length of the lane terminal.

3. The traffic monitoring system according to claim 1 including at least one transverse link interconnecting the first, second, and third network backbones.

4. The traffic monitoring system according to claim 3 including a principal network backbone connected to the transverse link and providing an interconnection between the first, second, and third lines network backbones and the data processor.

5. The traffic monitoring system according to claim 4 including a traffic data base connected to the data processor through the principal network backbone for storing traffic information including passing vehicles detected by the sensor for processing by the data processor.

6. The traffic monitoring system according to claim 4 including a video camera controlled by the data processor through the principal network backbone for forming an image of traffic on the highway.

7. The traffic monitoring system according to claim 4 including a toll server connected to the principal network backbone and receiving information from the lane terminals for determining a toll of a vehicle traveling on the highway based upon the lane traveled by the vehicle.

8. The traffic monitoring system according to claim 1 wherein groups of lane terminals define communication cells for communication with vehicles traveling on the highway and including a cell management data base connected to the data processor for identifying positions of specific vehicles on the highway with respect to the communication cells.

9. The traffic monitoring system according to claim 1 comprising a plurality of mobile transceivers mounted on respective vehicles for sending signals to the lane terminals identifying the respective vehicle on which a transceiver is mounted.

10. The traffic monitoring system according to claim 9 wherein traffic information from the data processor is transmitted to the lane terminals through the principal network backbone and the transverse link and transmitted to the mobile transceivers by the lane terminals.

11. The traffic monitoring system according to claim 10 wherein the traffic information includes information on the vehicles nearest a vehicle receiving the traffic information from the data processor.

12. The traffic monitoring system according to claim 11 including a plurality of mobile graphical displays mounted on respective vehicles for displaying locations of vehicles nearest the respective vehicle on which containing a graphical display is mounted.

* * * * *